US007627279B2

(12) United States Patent
Ardery et al.

(10) Patent No.: US 7,627,279 B2
(45) Date of Patent: Dec. 1, 2009

(54) FUSER ASSEMBLY HAVING COMPLIANT END CAP

(75) Inventors: Jeffrey Allen Ardery, Richmond, KY (US); Douglas C. Hamilton, Lexington, KY (US); Jason Kyle Romain, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 114 days.

(21) Appl. No.: 11/839,581

(22) Filed: Aug. 16, 2007

(65) Prior Publication Data

US 2009/0047047 A1 Feb. 19, 2009

(51) Int. Cl.
*G03G 15/20* (2006.01)

(52) U.S. Cl. ..... 399/329; 219/216; 399/328

(58) Field of Classification Search ..... 219/216; 399/320, 328, 329
See application file for complete search history.

(56) References Cited

U.S. PATENT DOCUMENTS 7,235,761 B1 * 6/2007 Maul et al. ..... 219/216
2007/0048044 A1 * 3/2007 Tokuhiro et al. ..... 399/329

* cited by examiner

*Primary Examiner*—Hoang Ngo
(74) *Attorney, Agent, or Firm*—Taylor & Aust, PC

(57) ABSTRACT

A fuser assembly configured to fix a toner image to a sheet of print media includes a fuser belt having a first side edge, a second side edge spaced apart from the first side edge, an exterior surface, an interior surface, and a hollow interior defined by the interior surface. A pair of end cap assemblies is positioned to locate the fuser belt, and the fuser belt is positioned between and supported by the pair of end cap assemblies. Each end cap assembly of the pair of end cap assemblies includes an end cap body and a belt support mechanism. The belt support mechanism is coupled to the end cap body for supporting the fuser belt and is configured to be compliant in a direction perpendicular to a rotational axis of the fuser belt to apply a biasing force to the interior surface of the fuser belt.

20 Claims, 8 Drawing Sheets

FUSER ASSEMBLY HAVING COMPLIANT END CAP

BACKGROUND OF THE INVENTION

1. Field of the Invention

The present invention relates to electrophotographic imaging devices, and, more particularly, to a fuser assembly having a compliant end cap.

2. Description of the Related Art

An electrophotographic imaging apparatus, such as a laser printer, forms a latent image on a surface of a photoconductive material by selectively exposing an area of the surface to light. The latent electrostatic image is developed into a visible image by electrostatic toners which contain pigment components and thermoplastic components. The photoconductor may be either positively or negatively charged, and the toner system similarly may contain negatively or positively charged particles. A print medium (e.g., a sheet of paper) or intermediate transfer medium is given an electrostatic charge opposite that of the toner and then passed close to a surface of the photoconductor, pulling the toner from the photoconductor onto the paper or immediate medium in the pattern of the image developed from the photoconductor. After the image is transferred to the print medium, the print medium is processed through a fuser assembly where it is heated and pressed. The fuser assembly includes a set of fuser rolls or belts, under heat, which melts and fixes the toner to the print medium surface thereby producing the printed image.

A belt fuser contains a belt whose axial location is controlled by an end cap attached to each end of a heater housing. The belt may be, for example, a polyimide tube having a Teflon® coating. The end cap has an approximate circular surface that fits inside the inside diameter of the belt to locate the belt up and down and front to back in the fuser. The approximate circular surface of the end cap is a shape to match the shape that the belt wants to take when the belt is pressed up against the heater by the back up roll. The end cap has a flange that controls the left to right axial movement of the belt. The belt is rotated by paper moving through the nip produced by the back up roller being pressed against the belt riding over a flat ceramic heater. The back up roll rotates and drives the paper. The end caps do not rotate.

There is clearance between the belt and the portion of the end cap fitting inside the belt's inner diameter so as to minimize friction between these surfaces. This clearance allows the belt axis of rotation to not be parallel to the back up roll axis of rotation. Also, the assembly of the belt and end caps may not be parallel to the back up roll axis of rotation due to manufacturing variations. Both of these effects produce a relative angle between the belt axis of rotation and the back up roll axis of rotation which causes the belt to move so that one end is pushing against the flange on the end cap. The end cap material contains glass fibers because of the load, e.g., 11 to 20 pounds, that the end cap must transmit to the back up roll to form the nip. During operation, the end of the belt wears away the plastic skin that covers these glass fibers. Once the glass fibers are exposed, the glass fibers will wear the side end(s) of the fuser belt and sometimes the side end(s) of the belt will catch on these fibers and tear. This tear causes the belt to fail and often occurs before the fuser has reached its desired life.

The relative angle between the belt axis of rotation and the back up roll axis of rotation also creates a point load. In addition to accelerated wear due to this point load, another failure mode is caused by this point load, which is a localized buckling of the fuser belt as the fuser belt contacts the end cap.

This buckling usually results in the belt bending over short distances. Since it is localized the buckling fatigues the end of the belt and can put a crease in the belt. Also, in more extreme cases, due to system tolerances, the belt can have noisy dynamic buckling, which can be easily heard outside of the machine. In any case, buckling results in fatigue of the belt which results in cracks in the belt in the axial direction and circumference direction. These cracks cause failure of the belt. Also, another cause for a point load on the belt is the run out of the belt. Using coupled force transducers, a belt force oscillation on the end cap flange has been observed with the same frequency as the belt rotation.

FIG. 1 is a graph having a shaded area DF1 representing a region of no belt deformation of a prior art fuser system that does not incorporate aspects of the present invention. In FIG. 1, the X axis is the relative angle between the belt axis of rotation and the back up roll axis of rotation that is given in terms of a displacement of the AC connector end of the ceramic heater with respect to the back up roll shaft, which is called plug skew in millimeters (mm). The Y axis is the rotation of the end cap flange in degrees. As is observed from the graph of FIG. 1, the graph region below the X axis depicts a region almost completely covered with belt deformation.

What is needed in the art is a fuser assembly that reduces fuser belt deformation.

SUMMARY OF THE INVENTION

The terms "first" and "second" preceding an element name, e.g., a first side edge, a second side edge, etc., are used for identification purposes to distinguish between similar elements, and are not intended to necessarily imply order, nor are the terms "first" and "second" intended to preclude the inclusion of additional similar elements.

The invention, in one form thereof, is directed to a fuser assembly configured to fix a toner image to a sheet of print media. The fuser assembly includes a fuser belt having a first side edge, a second side edge spaced apart from the first side edge, an exterior surface, an interior surface, and a hollow interior defined by the interior surface. A pair of end cap assemblies is positioned to locate the fuser belt, and the fuser belt is positioned between and supported by the pair of end cap assemblies. Each end cap assembly of the pair of end cap assemblies includes an end cap body and a belt support mechanism. The belt support mechanism is coupled to the end cap body for supporting the fuser belt and is configured to be compliant in a direction perpendicular to a rotational axis of the fuser belt to apply a biasing force to the interior surface of the fuser belt.

The invention, in another form thereof, is directed to an electrophotographic imaging apparatus for forming an image on a sheet of print media. The electrophotographic imaging apparatus includes a media feed section for feeding the sheet of print media along a media feed path. A laser scanning device is configured to produce a scanned light beam. An image-forming device has a photosensitive body, and is configured to use the scanned light beam to form a latent image on the photosensitive body and develop the latent image to form a toner image that is transferred to the sheet of print media. A fuser assembly is configured to fix the toner image to the sheet of print media. The fuser assembly includes a fuser belt having a first side edge, a second side edge spaced apart from the first side edge, an exterior surface, an interior surface, and a hollow interior defined by the interior surface. A pair of end cap assemblies is positioned to locate the fuser belt, and the fuser belt is positioned between and supported by the pair of end cap assemblies. Each end cap assembly of the pair of end cap assemblies includes an end cap body and a belt support mechanism. The belt support mechanism is coupled to the end cap body for supporting the fuser belt and is configured to be compliant in a direction perpendicular to a rotational axis of the fuser belt to apply a biasing force to the interior surface of the fuser belt.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 2:
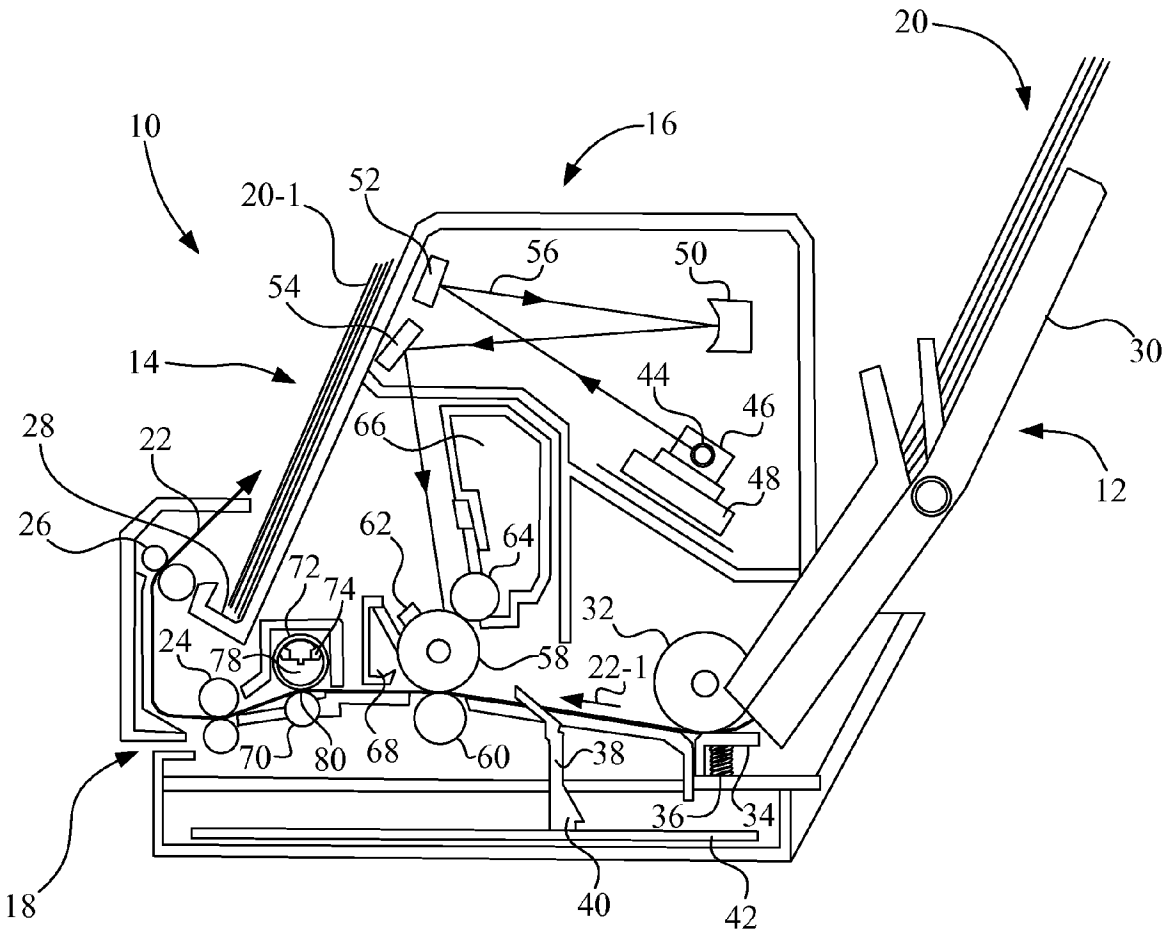
FIG. 2 is a diagrammatic representation of an electrophotographic imaging apparatus configured in accordance with an embodiment of the present invention.

Referring now to the drawings and particularly to FIG. 2, there is shown an exemplary electrophotographic imaging apparatus 10, e.g., a laser printer, configured in accordance with an embodiment of the present invention. Imaging apparatus 10 includes a media feed section 12, an image-forming device 14, a laser scanning device 16, and a fuser assembly 18.

Media feed section 12 sequentially transports a sheet of print media (e.g., paper) 20-1 from a stack of sheets of print media 20 to image-forming device 14. Each sheet of print media 20-1 moves along a media feed path 22. Image-forming device 14 transfers a toner image to transported sheet of print media 20-1. Fuser assembly 18 fixes the toner image to the sheet of print media 20-1 sent from image-forming device 14. Thereafter, the sheet of print media 20-1 is ejected out of imaging apparatus 10 by media transport rollers 24, 26 and into output tray 28.

In the exemplary imaging apparatus 10, the media feed section 12 includes a feed tray 30, a feed roller 32, a media separating friction plate 34, a pressure spring 36, a media detection actuator 38, a media detection sensor 40, and a control circuit 42. Upon receiving a print instruction, the sheets of print media 20 which have been placed in media feed tray 30 are fed one-by-one by operation of feed roller 32, media separating friction plate 34 and pressure spring 36. As the fed sheet of print media 20-1 pushes down media detection actuator 38, media detection sensor 40 outputs an electrical signal instructing commencement of printing of the image. Control circuit 42, started by operation of media detection actuator 38, transmits an image signal to a laser diode light-emitting unit 44 of laser scanning device 16 so as to control the ON/OFF condition of its associated light-emitting diode.

Laser scanning device 16 includes laser diode light-emitting unit 44, a scanning mirror 46, a scanning mirror motor 48, and reflecting mirrors 50, 52, and 54. Scanning mirror 46 is rotated at a constant high speed by scanning mirror motor 48 such that laser light beam 56 scans in a vertical direction to the print media surface. The laser light beam 56 radiated by laser diode light-scanning unit 44 is reflected by reflecting mirrors 50, 52, and 54 so as to be applied to a photosensitive body 58 of image-forming device 14. When the laser light beam 56 is applied to photosensitive body 58, photosensitive body 58 is selectively exposed to the laser light beam 56 in accordance with ON/OFF information from control circuit 42.

In addition to photosensitive body 58, image-forming device 14 includes a transfer roller 60, a charging member 62, and a developer, including a developing roller 64, a developing unit 66, and a cleaning unit 68. The surface charge of photosensitive body 58, charged in advance by charging member 62, is selectively discharged by the laser light beam 56. An electrostatic latent image is thus formed on the surface of photosensitive body 58. The electrostatic latent image is visualized by developing roller 64, and developing unit 66. Specifically, the toner supplied from developing unit 66 is adhered to the electrostatic latent image on photosensitive body 58 by developing roller 64 so as to form the toner image.

Toner used for development is stored in developing unit 66. The toner contains coloring components (such as carbon black for black toner) and thermoplastic components. The toner, charged by being appropriately stirred in developing unit 66, adheres to the above-mentioned electrostatic latent image by an interaction of the developing bias voltage applied to developing roller 64 and an electric field generated by the surface potential of photosensitive body 58, and thus conforms to the latent image, forming a visual toner image on photosensitive body 58. The toner typically has a negative charge when it is applied to the latent image, forming the visual toner image.

The sheet of print media 20-1 transported from media feed section 12 is transported downstream while being pinched by photosensitive body 58 and transfer roller 60. The sheet of print media 20-1 arrives at the transfer nip in timed coordination with the toned image on the photosensitive body 58. As the sheet of print media 20-1 is transported downstream, the toner image formed on photosensitive body 58 is electrically attracted and transferred to the sheet of print media 20-1 by an interaction with the electrostatic field generated by transfer voltage applied to transfer roller 60. Any toner that still remains on photosensitive body 58, not having been transferred to the sheet of print media 20-1, is collected by cleaning unit 68. Thereafter, the sheet of print media 20-1 is transported to fuser assembly 18.

Figure 3:
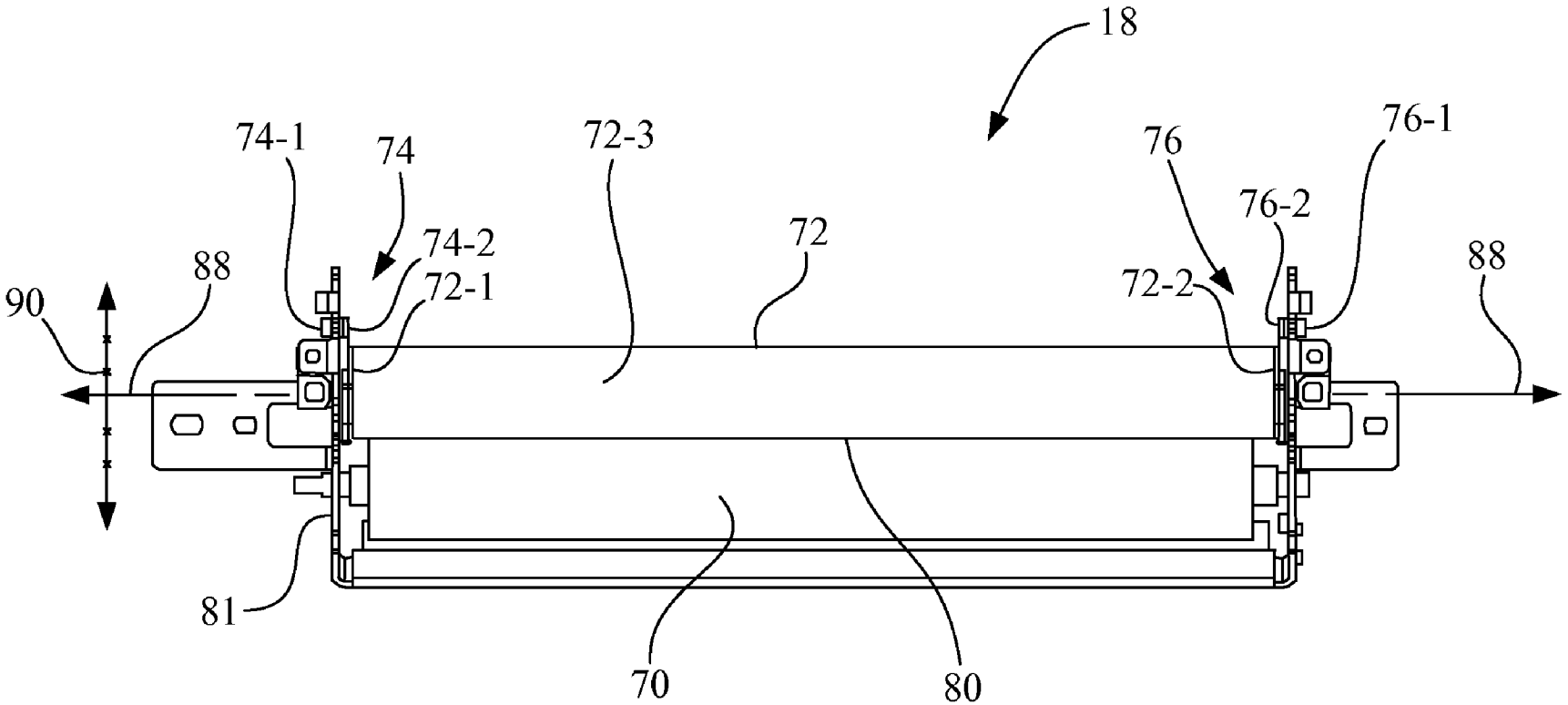
FIG. 3 is a front view of a fuser assembly used with the electrophotographic imaging apparatus of FIG. 2, and having compliant flanges positioned to engage side edges of a fuser belt.
Figure 4:
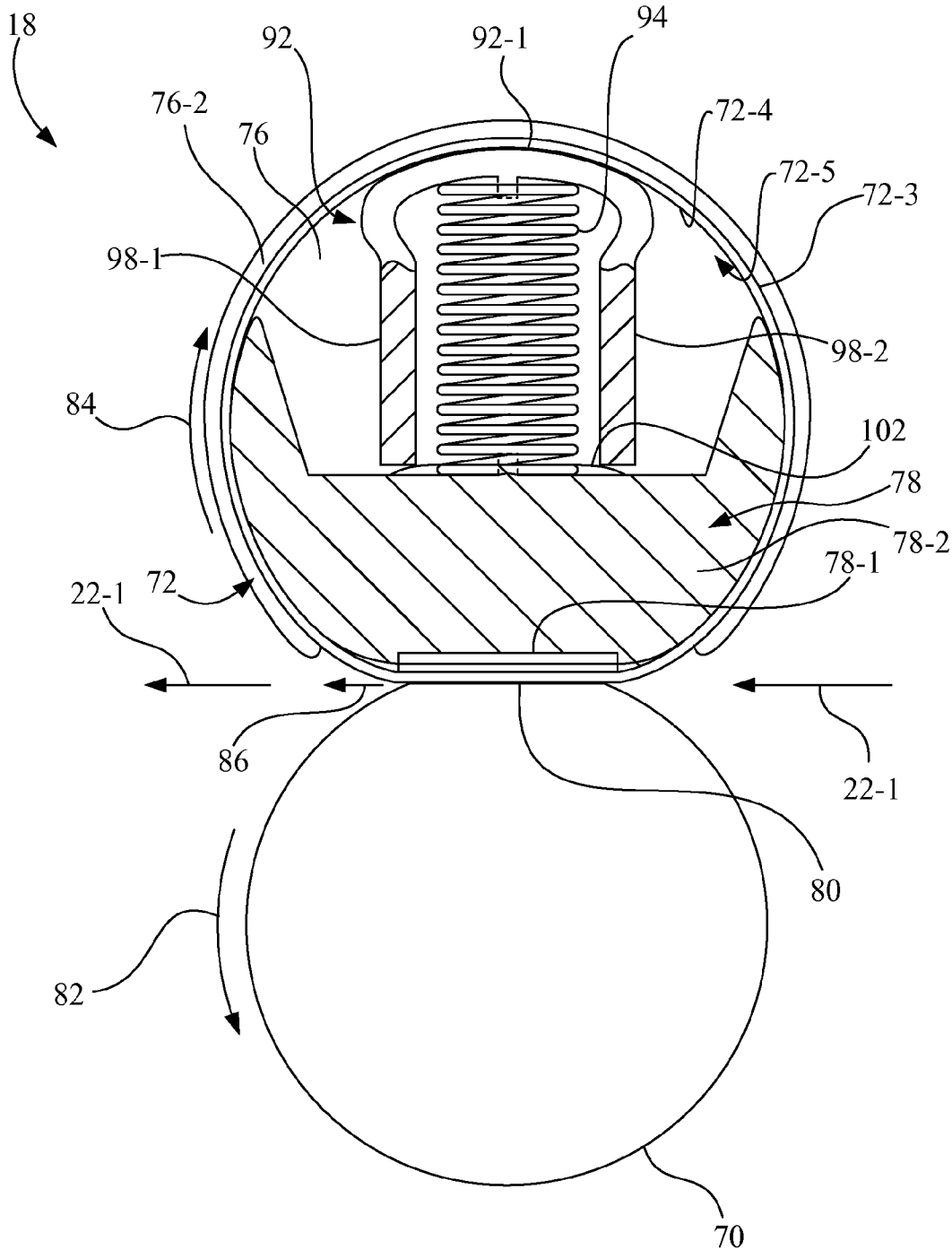
FIG. 4 is an end section view of a portion of the fuser assembly and backup roller of FIG. 3.

Referring also to FIGS. 3 and 4, fuser assembly 18 may include a backup roller 70, a fuser belt 72, a pair of end cap assemblies 74, 76, and a heater assembly 78. Fuser assembly 18 has a pair of end cap assemblies 74, 76 that are positioned to locate fuser belt 72, with fuser belt 72 being positioned between and supported by the pair of end cap assemblies 74, 76. Backup roller 70 and fuser belt 72 are positioned to form a fuser nip 80, and are mounted to a frame 81 which is used to mount fuser assembly 18 into imaging apparatus 10. As illustrated in FIG. 4, a rotation of backup roller 70 in a rotational direction 82 results in a corresponding reverse rotation of fuser belt 72 in a rotational direction 84, and fuser belt 72 moves in a belt moving direction 86 at fuser nip 80 in a direction corresponding to sheet feed direction 22-1.

The backup (i.e., pressure) roller 70 may be generally cylindrical in shape. Backup roller 70 may be made from, or is coated with, a material that has good release and transport properties for the sheet of print media 20-1. Backup roller 70 may be sufficiently soft so as to allow it to be rotated against fuser belt 72 to form fuser nip 80 through which the printed sheets of print media 20 travel. As a printed sheet of print media 20-1 passes through fuser nip 80, the sheet is placed under pressure, and the combined effects of this pressure, the time the sheet is in fuser nip 80, and the heat from fuser belt 72 acts to fix the toner onto the sheet of print media 20-1. Typically, the pressure between fuser belt 72 and backup roller 70 at fuser nip 80 is from about 5 pound per square inch (psi) to 30 psi.

Backup roller 70 may be formed, for example, from silicone rubber. Backup roller 70 may have an aluminum core with a silicone rubber layer molded or adhesively bonded onto its surface. Backup roller 70 may also have a fluoropolymer, e.g., Teflon® sleeve or coating. Backup roller 70 may be essentially hollow, having a metallic core, an outer metallic shell surrounding and essentially concentric with the core, and ribs between the core and the outer shell.

Fuser belt 72 is an endless belt having a first side edge 72-1, a second side edge 72-2, an exterior surface 72-3, an interior surface 72-4, and a hollow interior 72-5 that is defined by interior surface 72-4. Second side edge 72-2 is spaced apart from first side edge 72-1, with both exterior surface 72-3 and interior surface 72-4 extending therebetween. Fuser belt 72 is formed from a highly heat resistive and durable material having good parting properties and a thickness of not more than about 75 microns, and in one embodiment may be about 50 microns. Fuser belt 72 may be formed, for example, from a polyimide film or metal. Fuser belt 72 may have an outer coating of, for example, a fluororesin or Teflon® material to optimize release properties of the fixed toner. Fuser belt 72 may be shaped, for example, as a tube.

Heater assembly 78 applies an appropriate temperature and pressure to fuser belt 72 while the sheet of print media 20-1 is moving through fuser nip 80 formed by backup roller 70 and fuser belt 72. The thermoplastic components of the toner on the sheet of print media 20-1 are melted by fuser belt 72 and fixed to the sheet of print media 20-1 to form the fixed image. The sheet of print media 20-1 is then transported and ejected out of the printer by media transport rollers 24, 26 (see FIG. 2) and into output tray 28 where it may be stacked, one sheet upon another.

As illustrated in FIG. 4, heater assembly 78 is located in hollow interior 72-5 of fuser belt 72. Heater assembly 78 includes a heater body 78-1 and a heater housing 78-2. Heater housing 78-2 is configured to mount heater body 78-1, and may be formed from a plastic material. Also, when fuser assembly 18 is assembled, each end cap assembly 74 and 76 may be attached to heater housing 78-2, with heater assembly 78 being coupled between the pair of end cap assemblies 74, 76. Heater body 78-1 may be formed, for example, using a ceramic substrate having a series of thick film printed resistive materials, conductive materials, and insulative materials. Heater body 78-1 is positioned to contact interior surface 72-4 of fuser belt 72, so that heater assembly 78 is thermally coupled to fuser belt 72. A lubricant, such as oil or grease, provides lubrication between interior surface 72-4 of fuser belt 72 and heater body 78-1.

End cap assemblies 74, 76 are configured in accordance with the present invention to reduce wear and deformation of fuser belt 72. In the present embodiment, end cap assemblies 74, 76 may be configured structurally to be mirror images of one another, i.e., configured to be substantially identical. Referring to FIG. 3, end cap assemblies 74, 76 are positioned to control an axial location of fuser belt 72 along a belt axis of rotation 88 of fuser belt 72 and control a radial location of fuser belt 72 in radial directions 90. Radial direction(s) 90 are perpendicular to belt axis of rotation 88.

End cap assembly 74 has an end cap body 74-1 to which a compliant flange 74-2 is coupled. Compliant flange 74-2 may be made, for example, of a high temperature plastic that does not include glass fibers, and has a smooth surface for engaging first side edge 72-1 of fuser belt 72. Compliant flange 74-2 is positioned to engage first side edge 72-1 of fuser belt 72, if fuser belt 72 drifts sideways, i.e., axially along belt axis 88, to the left in the orientation as shown in FIG. 3.

End cap assembly 76 has an end cap body 76-1 to which a compliant flange 76-2 is coupled. Compliant flange 76-2 may be made, for example, of a high temperature plastic that does not include glass fibers, and has a smooth surface for engaging second side edge 72-2 of fuser belt 72. Compliant flange 76-2 is positioned to engage second side edge 72-2 of fuser belt 72, if fuser belt 72 drifts sideways, i.e., axially along belt axis 88, to the right in the orientation as shown in FIG. 3.

As used herein, the term compliant flange means a component, such as a thrust bearing, e.g., a thrust washer, configured to allow flexure in a direction of axial extent, i.e., in the direction(s) of axis 88. Each compliant flange 74-2, 76-2 may, for example, have a spring rate in the direction(s) of the axial extent that is selected to allow the respective compliant flange to deflect, i.e., flex, in the direction of the axial extent when engaged by the respective side edge 72-1, 72-2 of fuser belt 72, i.e., to be compliant in a direction parallel to rotational axis 88 of said fuser belt 72.

End cap assembly 76 is substantially a mirror image of end cap assembly 74, and accordingly, for ease of discussion, only the structure of end cap assembly 76 will be discussed in further detail below. It is to be understood, however, that any description of the structure or operation of end cap assembly 76 also will apply to end cap assembly 74.

Figure 5:
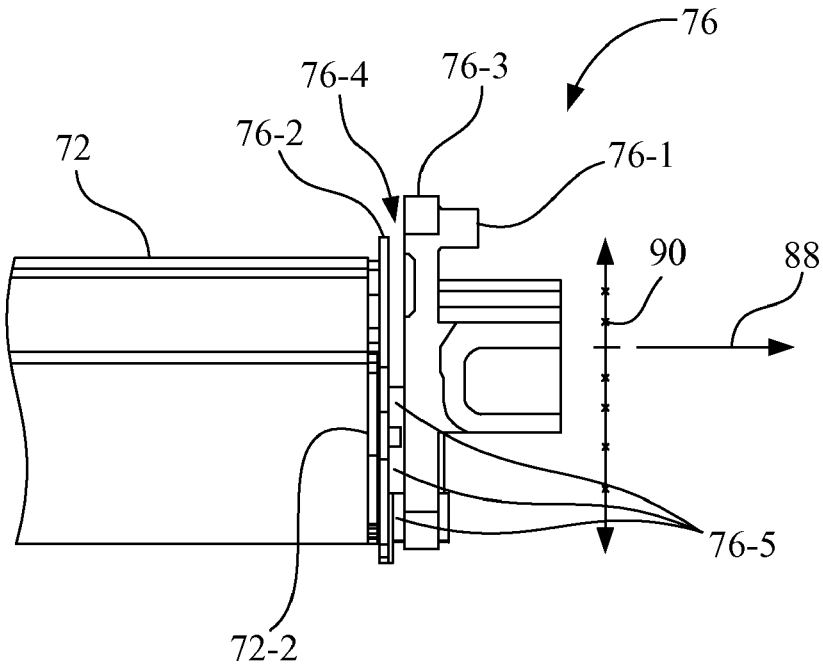
FIG. 5 is a side view of a portion of the fuser assembly of FIG. 3, with one of the end cap assemblies shown in more detail in engagement with the fuser belt.
Figure 6:
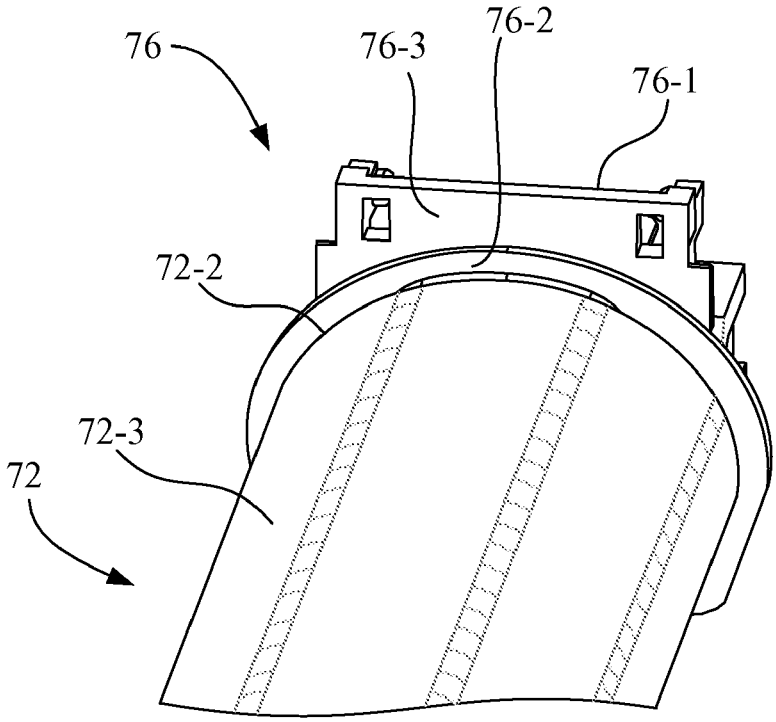
FIG. 6 is a top perspective view of the end cap assembly of FIG. 5.

As further illustrated in FIGS. 5 and 6, in the present embodiment end cap assembly 76 includes a rigid outer flange 76-3, with a perimetrical groove 76-4 located between compliant flange 76-2 and rigid outer flange 76-3. In the present embodiment, spacer standoffs 76-5 have a horizontal extent with respect to the belt axis of rotation 88 to define a width of perimetrical groove 76-4, and may be formed, for example, on rigid outer flange 76-3. In the present embodiment, end cap body 76-1, compliant flange 76-2, and rigid outer flange 76-3 may be formed as an integral single-piece unit, or alternatively, may be formed by discrete components.

Figure 1:
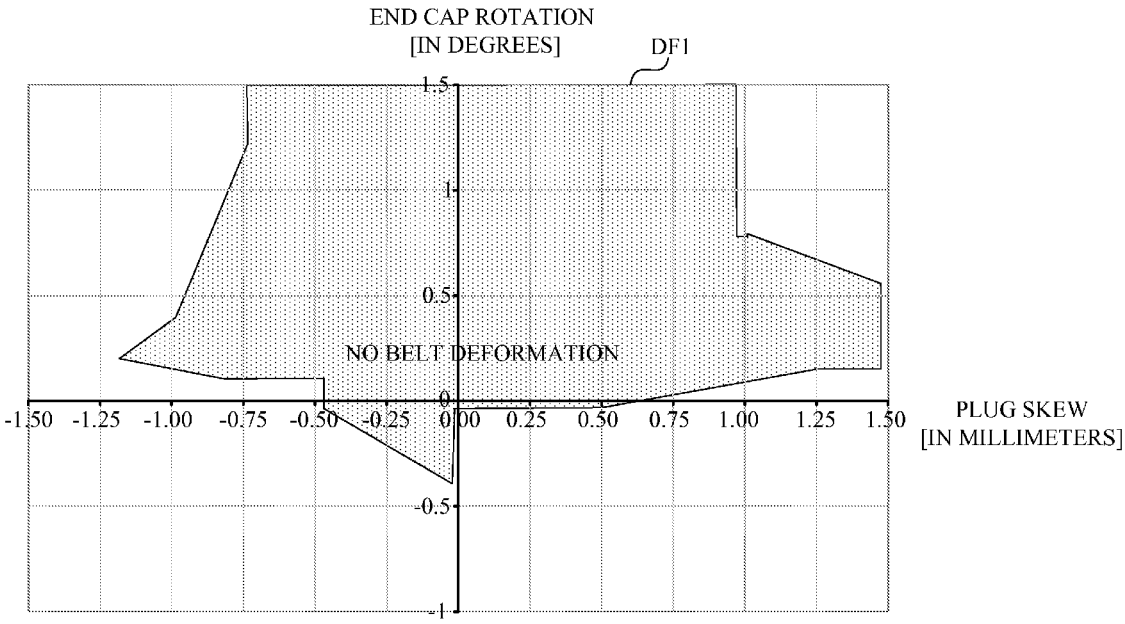
Fig. 1 (PRIOR ART)
FIG. 1 is a graph having a shaded area representing a region of no belt deformation of a prior art fuser system.
Figure 7:
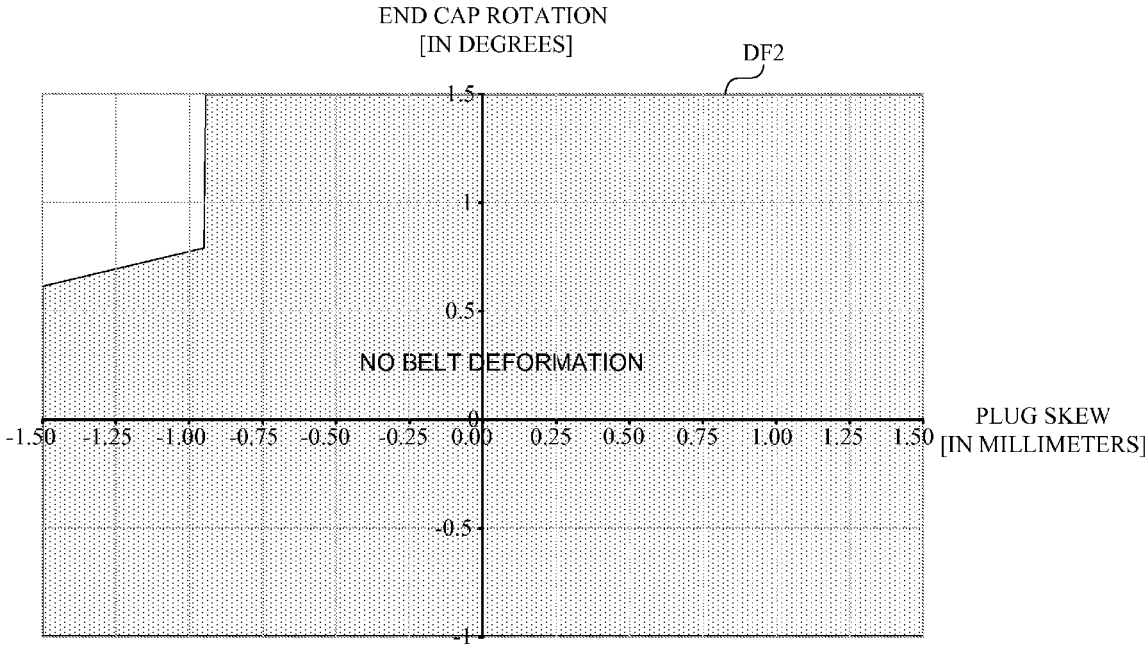
FIG. 7 is a graph having a shaded area representing a region of no belt deformation for a fuser assembly configured in accordance with an embodiment of the present invention.

The FIG. 7 is a graph having a shaded area DF2 representing a region of no belt deformation for fuser assembly 18 configured with compliant flanges positioned to engage the side edges of fuser belt 72 if fuser belt 72 shifts right or left during rotation. In FIG. 7, the X axis is the relative angle between the belt axis of rotation and the back up roll axis of rotation that is given in terms of a displacement of the AC connector end of the ceramic heater with respect to the back up roll shaft, which is called plug skew in millimeters (mm). The Y axis is the rotation of the end cap flange in degrees. As is observed from the graph of FIG. 7, shaded area DF2 is much larger the shaded area DF1 of FIG. 1, thus demonstrating an improvement in increasing the range of no belt deformation in comparison to prior art fuser systems represented by FIG. 1.

Figure 8:
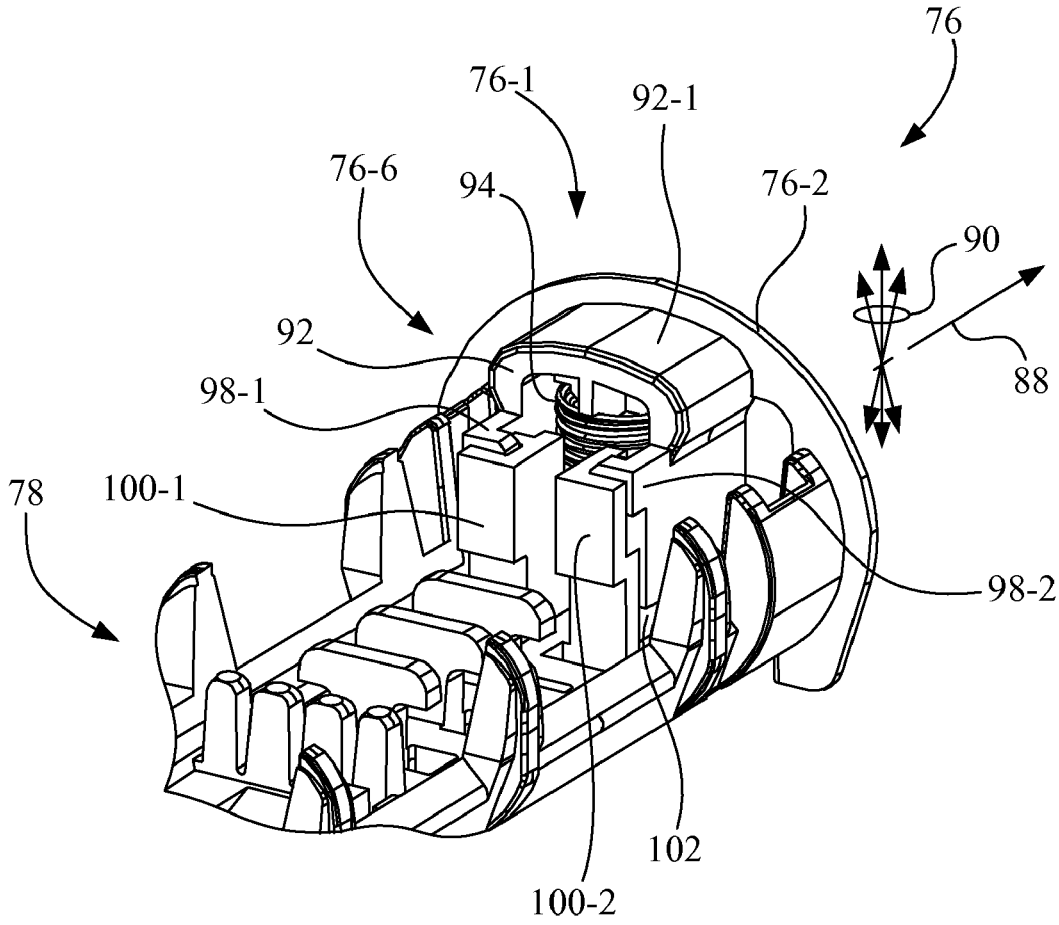
FIG. 8 is a perspective view of an end cap assembly having a belt support mechanism in accordance with an embodiment of the present invention, with the end cap assembly being mounted to a heater assembly.

As illustrated in FIGS. 4 and 8, in the present embodiment end cap assembly 76 further includes a belt support mechanism 76-6. Belt support mechanism 76-6 is coupled, directly or indirectly, to end cap body 76-1. Belt support mechanism 76-6 is configured to be compliant in radial directions 90, perpendicular to axis of rotation 88 of fuser belt 72, to apply a biasing force to interior surface 72-4 of fuser belt 72 in order to provide internal support for fuser belt 72 and reduce the tendency for fuser belt 72 to buckle in the region of fuser belt 72 near the respective side edge, e.g., side edge 72-2 with respect to end cap assembly 76 (see FIG. 6).

Belt support mechanism 76-6 includes a belt support 92 and a spring 94.

Belt support 92 is movably coupled to end cap body 76. In one embodiment, for example, belt support 92 and compliant flange 76-2 are formed as discrete parts, with belt support 92 moving independently with respect to compliant flange 76-2. However, it is contemplated that in another embodiment, belt support 92 and compliant flange 76-2 may be formed as an integral unit.

In the present embodiment, belt support 92 is formed as a slide member having guide rails 98-1, 98-2 that engage respective vertical channels 100-1, 100-2 of end cap body 76-1. Alternatively, vertical channels 100-1, 100-2 may be formed on heater assembly 78.

Belt support 92 has a belt support surface 92-1. Belt support 92 is positioned in hollow interior 72-5 of fuser belt 72. Belt support 92 may be made, for example, of a high temperature plastic. Belt support 92 has a smooth belt support surface 92-1 for contacting interior surface 72-4 of fuser belt 72. Belt support surface 92-1 contacts interior surface 72-4 of fuser belt 72 at a location generally opposite to fuser nip 80. While in the present embodiment spring 94 is shown as a coil spring, those skilled in the art will recognize that spring 94 may take other forms, such as for example, as a flat spring or leaf spring. Spring 94 may be formed, for example, from metal or plastic In the present embodiment, spring 94 is positioned vertically between a lower portion 102 of end cap body 76-1 and a portion of movable belt support 92 near belt support surface 92-1. In addition, spring 94 is positioned horizontally between guide rails 98-1 and 98-2 of belt support 92. In the present arrangement, belt support 92 is thus compliant in the direction (i.e., in radial directions 90) perpendicular to rotational axis 88 of fuser belt 72. Spring 94 applies a biasing force, such as for example in a range of (0.7105 Newtons (72.5 grams) to 1.8955 Newtons (193.3 grams) to belt support 92 to position and hold belt support surface 92-1 in contact with interior surface 72-4 of fuser belt 72.

Figure 9:
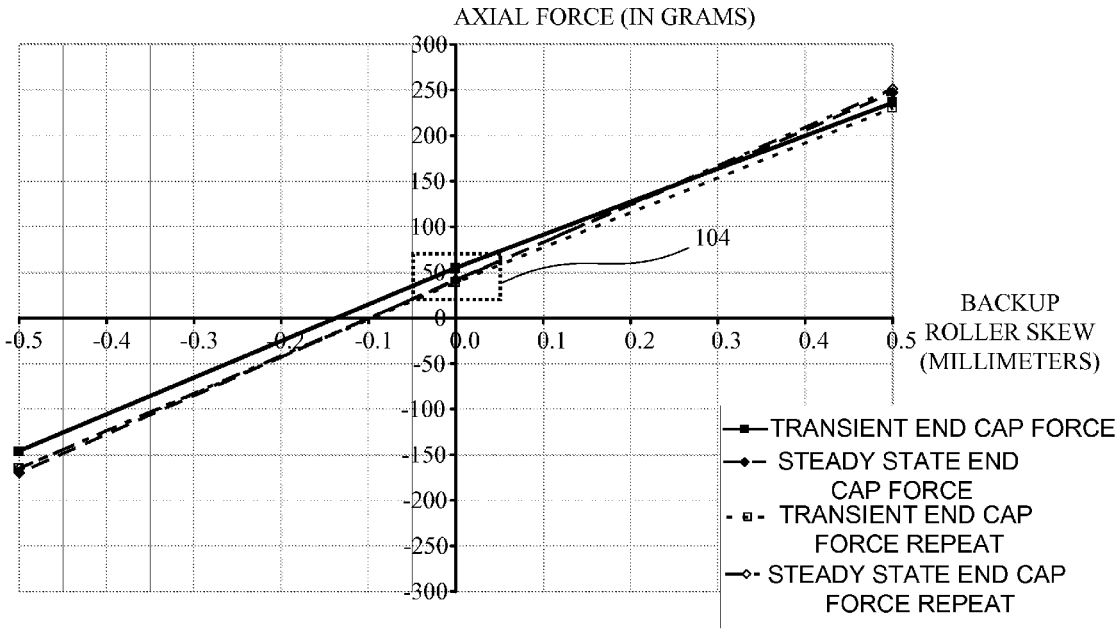
FIG. 9 is a graph that plots an axial force exerted by the fuser belt on an end cap assembly versus backup roller skew of the backup roller in an embodiment that includes the belt support mechanism of FIG. 8.

FIG. 9 shows a graph that plots an axial force exerted by fuser belt 72 on end cap assembly 76 versus backup roller skew of backup roller 70 in an embodiment that includes belt support mechanism 76-6. As shown, when considering the transient force, steady state force, transient force repeated, and steady state force repeated, an operating window 104 is achieved having an axial force range of about +20 to +70 grams, with a backup roller skew of −0.05 millimeters to +0.05 millimeters.

In comparison, in an embodiment that does not include belt support mechanism 76-6, the axial force exerted by fuser belt 72 on end cap assembly 76 versus backup roller skew of backup roller 70 may result in an operating window having an axial force in a range of about −225 to +240 grams in relation to a backup roller skew of −0.05 millimeters to +0.05 millimeters due to the presence of a clearance between the interior surface 72-4 of fuser belt and a support surface of the end cap positioned in hollow interior 72-5 of fuser belt 72.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fuser assembly configured to fix a toner image to a sheet of print media, said fuser assembly comprising:

a fuser belt having a first side edge, a second side edge spaced apart from said first side edge, an exterior surface, an interior surface, and a hollow interior defined by said interior surface; and a pair of end cap assemblies positioned to locate said fuser belt, said fuser belt being positioned between and supported by said pair of end cap assemblies, each end cap assembly of said pair of end cap assemblies including:

an end cap body; and a belt support mechanism coupled to said end cap body for supporting said fuser belt and configured to be compliant in a direction perpendicular to a rotational axis of said fuser belt to apply a biasing force to said interior surface of said fuser belt.

2. The fuser assembly of claim 1, wherein said belt support mechanism includes:

a belt support movably coupled to said end cap body, said belt support having a belt support surface, said belt support being positioned in said hollow interior of said fuser belt; and a spring that applies a biasing force to said belt support to position said belt support surface in contact with said interior surface of said fuser belt.

3. The fuser assembly of claim 2, wherein said spring is positioned between said end cap body and said belt support.

4. The fuser assembly of claim 2, wherein said belt support is compliant in said direction perpendicular to said rotational axis of said fuser belt.

5. The fuser assembly of claim 2, wherein said belt support is made of a high temperature plastic, and said belt support surface is a smooth surface for contacting said interior surface of said fuser belt.

6. The fuser assembly of claim 1, wherein each end cap assembly of said pair of end cap assemblies further includes a flange coupled to said end cap body and positioned to engage a corresponding side edge of said fuser belt.

7. The fuser assembly of claim 6, wherein said flange is formed to be compliant in a direction parallel to said rotational axis of said fuser belt.

8. The fuser assembly of claim 7, wherein said flange is made of a high temperature plastic that does not include glass fibers, and has a smooth surface for contacting said corresponding side edge of said fuser belt.

9. The fuser assembly of claim 1, wherein:

each end cap assembly of said pair of end cap assemblies further includes a compliant flange coupled to said end cap body and positioned to engage a corresponding side edge of said fuser belt; and said belt support mechanism includes:

a belt support movably coupled to said end cap body, said belt support having a belt support surface, said belt support being positioned in said hollow interior of said fuser belt; and a spring that applies a biasing force to said belt support to position said belt support surface in contact with said interior surface of said fuser belt, said compliant flange and said belt support being formed as an integral unit.

10. The fuser assembly of claim 1, wherein:

each end cap assembly of said pair of end cap assemblies further includes a compliant flange coupled to said end cap body and positioned to engage a corresponding side edge of said fuser belt; and said belt support mechanism includes:

a belt support movably coupled to said end cap body, said belt support having a belt support surface, said belt support being positioned in said hollow interior of said fuser belt; and a spring that applies a biasing force to said belt support to position said belt support surface in contact with said interior surface of said fuser belt, said compliant flange and said belt support being formed as discrete components.

11. An electrophotographic imaging apparatus for forming an image on a sheet of print media, comprising:

a media feed section for feeding said sheet of print media along a media feed path;

a laser scanning device configured to produce a scanned light beam;

an image-forming device having a photosensitive body, and configured to use said scanned light beam to form a latent image on said photosensitive body and develop said latent image to form a toner image that is transferred to said sheet of print media; and a fuser assembly configured to fix said toner image to said sheet of print media, said fuser assembly including:

a fuser belt having a first side edge and a second side edge; and a pair of end cap assemblies positioned to locate said fuser belt, said fuser belt being positioned between and supported by said pair of end cap assemblies, each end cap assembly of said pair of end cap assemblies including:

an end cap body; and a belt support mechanism coupled to said end cap body for supporting said fuser belt and configured to be compliant in a direction perpendicular to a rotational axis of said fuser belt to apply a biasing force to said interior surface of said fuser belt.

12. The electrophotographic imaging apparatus of claim 11, wherein said belt support mechanism includes:

a belt support movably coupled to said end cap body, said belt support having a belt support surface, said belt support being positioned in said hollow interior of said fuser belt; and a spring that applies a biasing force to said belt support to position said belt support surface in contact with said interior surface of said fuser belt.

13. The electrophotographic imaging apparatus of claim 12, wherein said spring is positioned between said end cap body and said belt support.

14. The electrophotographic imaging apparatus of claim 12, wherein said belt support is compliant in said direction perpendicular to said rotational axis of said fuser belt.

15. The electrophotographic imaging apparatus of claim 12, wherein said belt support is made of a high temperature plastic, and said belt support surface is a smooth surface for contacting said interior surface of said fuser belt.

16. The electrophotographic imaging apparatus of claim 11, wherein each end cap assembly of said pair of end cap assemblies further includes a flange coupled to said end cap body and positioned to engage a corresponding side edge of said fuser belt.

17. The electrophotographic imaging apparatus of claim 16, wherein said flange is formed to be compliant in a direction parallel to said rotational axis of said fuser belt.

18. The electrophotographic imaging apparatus of claim 17, wherein said flange is made of a high temperature plastic that does not include glass fibers, and has a smooth surface for contacting said corresponding side edge of said fuser belt.

19. The electrophotographic imaging apparatus of claim 11, wherein:

each end cap assembly of said pair of end cap assemblies further includes a compliant flange coupled to said end cap body and positioned to engage a corresponding side edge of said fuser belt; and said belt support mechanism includes:

a belt support movably coupled to said end cap body, said belt support having a belt support surface, said belt support being positioned in said hollow interior of said fuser belt; and a spring that applies a biasing force to said belt support to position said belt support surface in contact with said interior surface of said fuser belt, said compliant flange and said belt support being formed as an integral unit.

20. The electrophotographic imaging apparatus of claim 11, wherein:

each end cap assembly of said pair of end cap assemblies further includes a compliant flange coupled to said end cap body and positioned to engage a corresponding side edge of said fuser belt; and said belt support mechanism includes:

a belt support movably coupled to said end cap body, said belt support having a belt support surface, said belt support being positioned in said hollow interior of said fuser belt; and a spring that applies a biasing force to said belt support to position said belt support surface in contact with said interior surface of said fuser belt, said compliant flange and said belt support being formed as discrete components.

* * * * *